US010541457B2

(12) United States Patent
Wang

(10) Patent No.: US 10,541,457 B2
(45) Date of Patent: Jan. 21, 2020

(54) BANDPASS FILTER HAVING RESONANT HOLES FORMED IN A BLOCK, WHERE THE RESONANT HOLES INCLUDE HOLLOWED-OUT SUB REGIONS

(71) Applicant: Xiamen Sunyear Electronics Co., Ltd., Xiamen (CN)

(72) Inventor: Junyuan Wang, Xiamen (CN)

( * ) Notice: Subject to any disclaimer, the term of this patent is extended or adjusted under 35 U.S.C. 154(b) by 25 days.

(21) Appl. No.: 15/878,471

(22) Filed: Jan. 24, 2018

(65) Prior Publication Data

US 2019/0103646 A1 Apr. 4, 2019

(30) Foreign Application Priority Data

Sep. 30, 2017 (CN) ..... 2017 1 0916183

(51) Int. Cl.

| | |
|---|---|
| ***H01P 1/205*** | (2006.01) |
| ***H01P 1/207*** | (2006.01) |
| ***H01P 7/06*** | (2006.01) |
| ***H01P 3/12*** | (2006.01) |
| ***H01P 7/04*** | (2006.01) |

(52) U.S. Cl.

CPC ..... *H01P 1/2056* (2013.01); *H01P 1/207* (2013.01); *H01P 3/12* (2013.01); *H01P 7/04* (2013.01); *H01P 7/06* (2013.01)

(58) Field of Classification Search

CPC ..... H01P 7/04; H01P 1/2056

USPC ..... 333/206

See application file for complete search history.

(56) References Cited

U.S. PATENT DOCUMENTS

| | | | | |
|---|---|---|---|---|
| 4,985,690 A * | 1/1991 | Eguchi | H01P 1/2053 | 333/206 |
| 5,994,978 A * | 11/1999 | Vangala | H01P 1/2056 | 333/134 |
| 6,204,738 B1 * | 3/2001 | Toda et al. | H01P 1/2056 | 333/134 |
| 6,549,101 B2 * | 4/2003 | Gotoh et al. | H01P 1/2056 | 333/202 |

* cited by examiner

*Primary Examiner* — Benny T Lee

(74) *Attorney, Agent, or Firm* — The Law Office of Austin Bonderer, PC; Austin Bonderer

(57) ABSTRACT

Provided is a multi-resonator bandpass filter, which comprises a block, an input electrode, and an output electrode. The block comprises an open surface, a short-circuited surface, and a top surface. Multiple of resonant holes are penetrated through the block. The open surface is provided with a first hollowed-out region; the top surface is provided with two second hollowed-out region; the input electrode and the output electrode are disposed on the two second hollowed-out region, respectively. The block further comprises a ground metal layer and a resonant coating layer. Each of the resonant holes is coaxially provided with a first groove and a second groove in the direction from the open surface to the short-circuited surface. The first groove is a rectangular shape in the cross-section parallel to the open surface, and the second groove is substantially a round shape in the cross-section parallel to the open surface.

9 Claims, 6 Drawing Sheets

BANDPASS FILTER HAVING RESONANT HOLES FORMED IN A BLOCK, WHERE THE RESONANT HOLES INCLUDE HOLLOWED-OUT SUB REGIONS

TECHNICAL FIELD

This disclosure relates to the technical field of the filter, and more particularly to a multi-resonator bandpass filter.

BACKGROUND ART

The dielectric filter is designed and manufactured by dielectric ceramic materials which contain features of low loss performance, high dielectric constant, low-frequency temperature coefficient, low coefficient of thermal expansion (CTE), and good power-handling capabilities. Generally, the dielectric filter is constituted by a plurality of long-length resonators which are connected in series or in parallel in the longitudinal direction. Such a dielectric filter has low insertion loss, superior power-handling capabilities, and narrow bandwidths.

The main advantages of the dielectric filter include high power capacity and low insertion loss. The existing dielectric filters, however, are large in size, which generally may reach the centimeter level. Additionally, under the influence of the physical characteristics of the dielectric filter, the electrical characteristics of the dielectric filter may become worse when its size being smaller.

Accordingly, it is desirable to provide a multi-resonator bandpass filter with small size and good electrical characteristics.

SUMMARY OF THE INVENTION

This disclosure provides a multi-resonator bandpass filter, aiming at overcoming the problem of being large in size of the existing dielectric filter.

The disclosure utilizes the following technical solution to solve the foregoing problem.

A multi-resonator bandpass filter is provided, which comprises a block, an input electrode, and an output electrode.

The block is a substantially rectangular solid shape and comprises an open-circuited surface (open-circuited surface), a short-circuited surface opposite to the open-circuited surface and a top surface connected between the open-circuited surface and the short-circuited surface; a plurality of resonant holes penetrate through the block, extending in parallel from the open-circuited surface to the short-circuited surface; the open-circuited surface is provided with a first hollowed-out region which is disposed around each resonant holes; the top surface is provided with two second hollowed-out regions, each of which extends to the open-circuited surface and connects to the first hollowed-out region, respectively; the input electrode and the output electrode are disposed on the two second hollowed-out region, respectively. The block further comprises a ground metal layer and a resonant coating layer; the ground metal layer is coated on all the outer surfaces of the block but the hollowed-out regions; the resonant coating layer is located inside the resonant holes, and is connected with the ground metal layer at the short-circuited surface to form a short-circuited end.

Each of the resonant holes is coaxially provided with a first groove and a second groove in the direction from the open-circuited surface to the short-circuited surface. The first groove is substantially a rectangular shape in the cross-section parallel to the open-circuited surface, and the second groove is substantially a round shape in the cross-section parallel to the open-circuited surface.

As a further improvement, a common side between the open-circuited surface and the top surface is defined as a first line. Multiple of the rectangular shapes are symmetrical with respect to a perpendicular bisector of the first line on the open-circuited surface.

As a further improvement, the round shapes have a common diameter. The minimum side length of the rectangular shape is larger than the diameter of the round shapes.

As a further improvement, a depth ratio of the first groove and the second groove in the direction from the open-circuited surface to the short-circuited surface ranges from ⅓ to ⅕.

As a further improvement, the block is provided with five resonant holes.

As a further improvement, the first hollowed-out region is symmetrical about the perpendicular bisector of the first line on the open-circuited surface, and the two-second hollowed-out regions are symmetrical to each other with respect to the perpendicular bisector of the first line on the top surface.

As a further improvement, the first hollowed-out region includes a first subregion, a second subregion, a third region, wherein the second subregion is disposed around the three resonant holes in the middle of the five resonant holes, and the first subregion and the third subregion are respectively disposed around the resonant holes on both sides.

As a further improvement, the two second hollowed-out regions are separately connected to the first subregion and the third region.

As a further improvement, the first line is defined as the long side of the open-circuited surface, and the top surface, wherein the length of the long side ranges from 6.2 mm to 5.4 mm. The length of the short side of the open-circuited surface ranges from 2.5 mm to 1.7 mm, and the length of the short side of the top surface ranges from 3.4 mm to 2.6 mm.

As a further improvement, the input electrode and the output electrode are disposed on the second hollowed-out region respectively by screen printing.

Compared to prior arts, the present disclosure has the following advantages.

The present disclosure provides a multi-resonator bandpass filter, which has a plurality of resonant holes penetrating through the block. Each of the resonant holes is constituted of a first groove and a second groove, wherein the first groove is of a rectangular shape in cross-section and the second groove is of round shape in cross-section. Such a design ensures that the filter has excellent electrical characteristics and largely reduces the entire size of the filter, and therefore in some way improves the application range of the filter.

There are five resonant holes arranged on the block of the multi-resonator bandpass filter in the present disclosure, which makes the present filter more suitable for the frequency band of 4 GHz~7 GHz. Furthermore, the filter also benefits from the length of the first line ranging from 6.2 mm to 5.4 mm, the length of other sides of the open-circuited surface except for the first line ranging from 2.5 mm to 1.7 mm, the length of the other side of the top surface except for the first line ranging from 3.4 mm to 2.6 mm.

The present disclosure provides a modified structure of the first groove and the second groove for the filter so that the filter can reach an electromagnetic coupling balance or a desired unbalance of the electromagnetic coupling, making the filter suitable for various of frequency bands.

NUMERICAL REFERENCES

Figure 1:
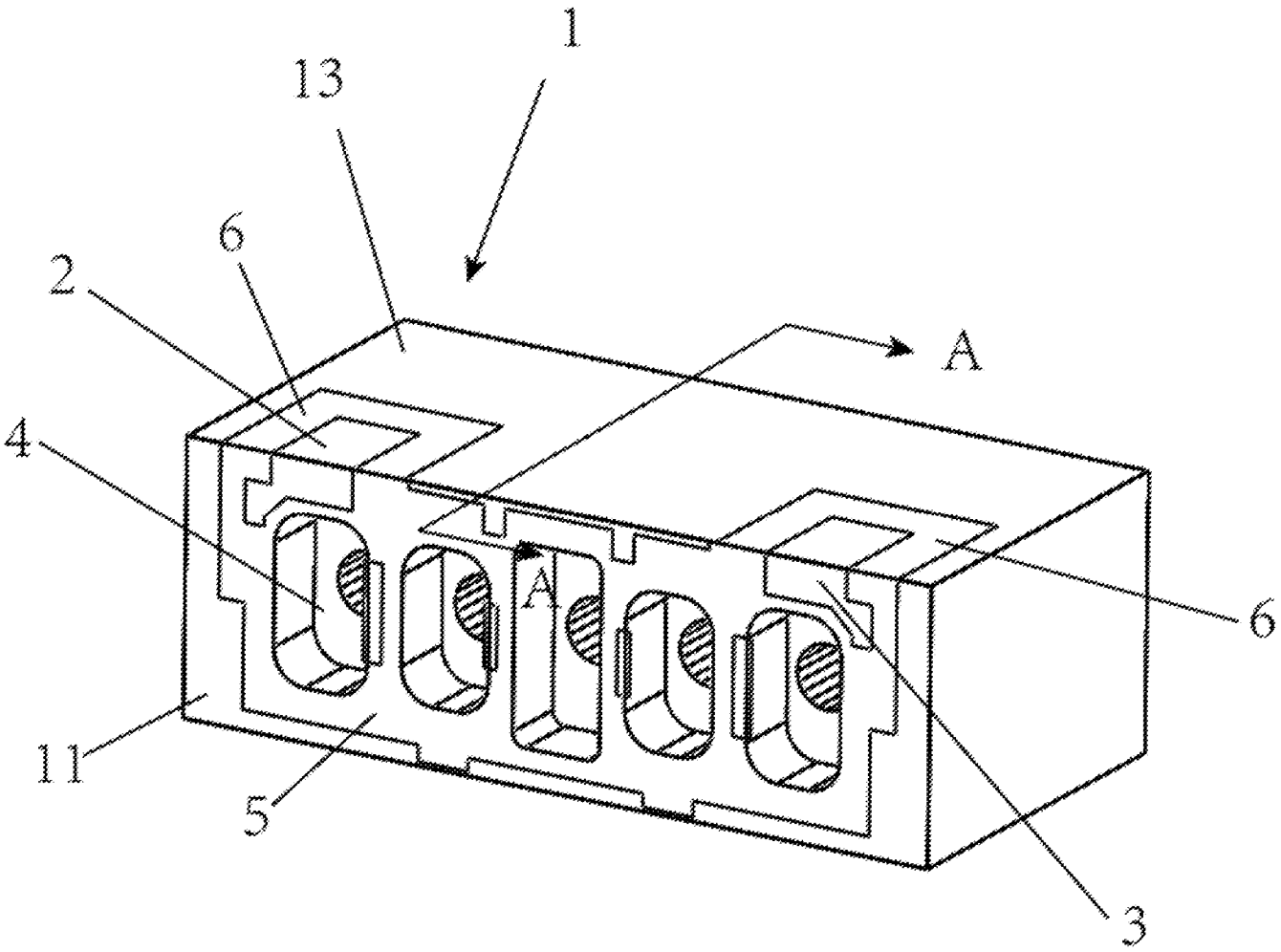
FIG. 1 is a perspective view of the multi-resonator bandpass filter in embodiment 1 according to the present disclosure.

Block 1
Open-circuited surface 11
Short-circuited surface 12
Top surface 13
Input electrode 2
Output electrode 3
Resonant hole 4
First groove 41
Second groove 42
First hollowed-out region 5
First subregion 51
Second subregion 52
Third subregion 53
Second hollowed-out region 6

DETAILED DESCRIPTION OF THE INVENTION

Hereinafter, this disclosure will be described in detail in combination with the embodiments and drawings for better understanding the objective, technical solutions and advantages of the present disclosure.

Embodiment 1

Figure 2:
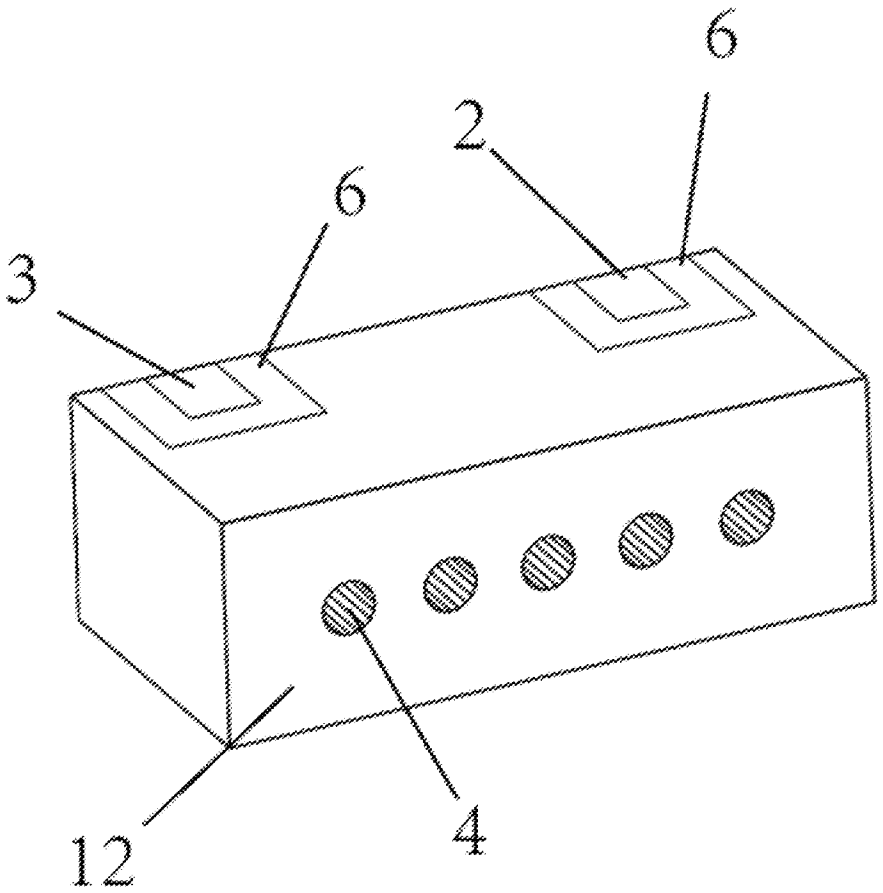
FIG. 2 is another perspective view of the multi-resonator bandpass filter in embodiment 1 according to the present disclosure.
Figure 3:
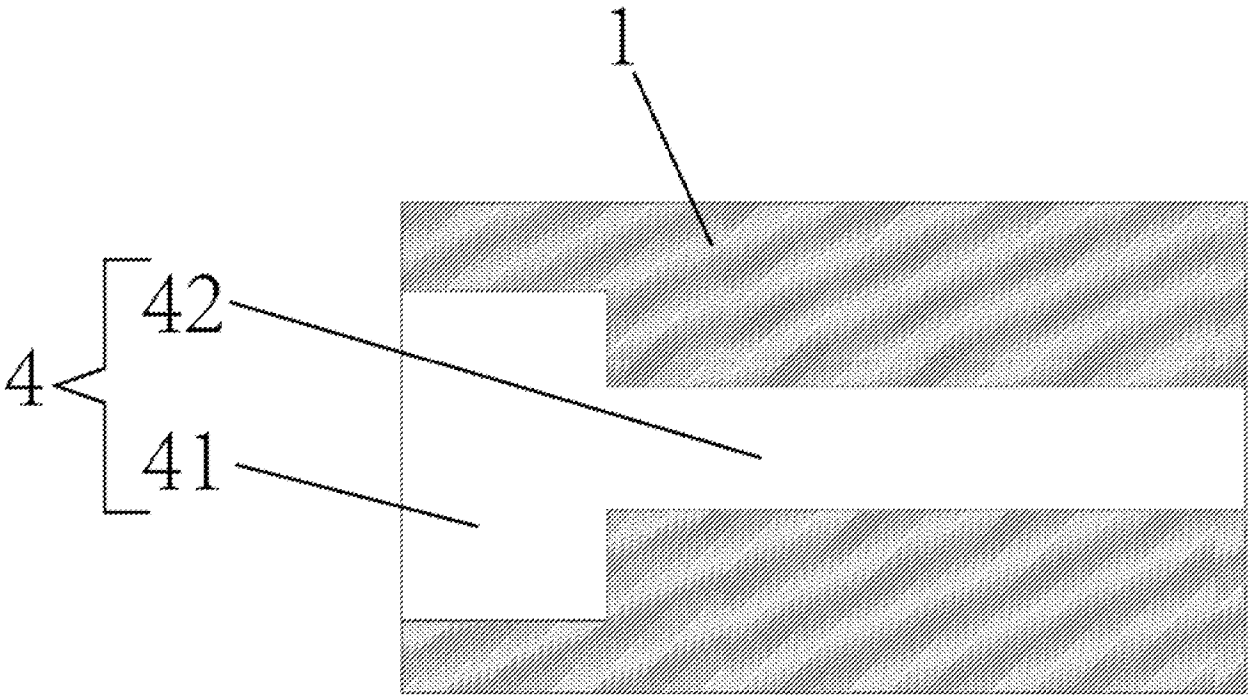
FIG. 3 is a cross-sectional view of the multi-resonator bandpass filter from the A-A direction in FIG. 1.

Please refer to FIGS. 1-3, in the embodiment, a multi-resonator bandpass filter is provided, which comprises a block 1 (FIGS. 1 and 3), an input electrode 2 (FIGS. 1 and 2) and an output electrode 3 (FIGS. 1 and 2).

The block 1 is a substantially rectangular solid shape. The block 1 is made of dielectric ceramic materials or other organic dielectric materials. The block 1 comprises an open-circuited surface (open-circuited surface) 11 (FIG. 1), a short-circuited surface 12 (FIG. 2) opposite to the open-circuited surface 11 and a top surface 13 connected between the open-circuited surface and the short-circuited surface. In the embodiment, a common edge between the open-circuited surface 11 and the top surface 13 is defined as a first line. The length of the first line is 6.2 mm to 5.4 mm. The length of the other sides of the open-circuited surface 11 except for the first line is 2.5 mm to 1.7 mm. The length of the other sides of the top surface 13 except for the first line is 3.4 mm to 2.6 mm. The filter provided in this disclosure can reduce the overall size by ⅓~⅔ as compared to the existing dielectric filter. Moreover, the filter having such a size helps the filter to be more suitable for the frequency band of 4 GHz~7 GHz.

A plurality of resonant holes 4 is penetrated through the block 1, extending in parallel from the open-circuited surface 11 to the short-circuited surface 12. The multi-resonant holes 4 are all perpendicular to the open-circuited surface 11, and therefore form as resonators of the filter. In the embodiment, there are five resonant holes 4.

The open-circuited surface 1 is provided with a first hollowed-out region 5 (FIG. 1). The hollowed-out region is the region left uncoated, making the body of the block 1 exposed to the outside. At the same time, the first hollowed-out region 5 is provided around each of the resonant holes 4.

The top surface 13 is provided with two second hollowed-out regions 6 (FIGS. 1 and 2). A space is created between the two second hollowed-out regions 6, so that the two second hollowed-out regions 6 does not contact one another. Each of the two second hollowed-out regions 6 extends to the open-circuited surface 11 and connects to the first hollowed-out region 5, respectively.

The input electrode 2 and the output electrode 3 are disposed on the two second hollowed-out regions 6 respectively, and the input electrode 2 and the output electrode 3 at least partially extend to the open-circuited surface 11. The input electrode 2 and the output electrode 3 are configured on the block 1 by screen printing. Alternatively, the input and out electrodes may be formed by high-temperature metallization silver electrode which is connected to the block 1. In another embodiment, the input and out electrodes may be a conductive metal layer coated on the outer surface of the block 1 formed by laser etching.

The block 1 further comprises a ground metal layer and a resonant coating layer. The ground metal layer is coated on all the outer surfaces of the block 1 except for the hollowed-out regions. The resonant coating layer is located inside the resonant holes, and is connected with the ground metal layer at the short-circuited surface 12 to form a short-circuited end. In this embodiment, the thickness of the ground metal layer may range from 6 μm to 20 μm, and the thickness of the resonant coating layer may range from 0.8 μm to 3.0 μm.

Referring to FIG. 3, in this embodiment, each of the resonant holes 4 is sequentially provided with a first groove 41 and a second groove 42 coaxially disposed in the direction from the open-circuited surface 11 to the short-circuited surface 12. The cross-section of the first groove 41 being parallel to the open-circuited surface 11 and is substantially of a rectangular shape, and each of the four angles of the rectangular shape comprises respective fillet. The cross-section of the second groove 42 being parallel to the open-circuited surface 11 and is substantially of a round shape. The first groove 41 is substantially of a rectangular solid shape and the second groove 42 is substantially of a round solid shape. A stepped portion is provided between the first groove 41 and the second groove 42. In each of the resonant holes 4, the length of the minimum sides of the rectangular shape is larger than the diameter of the round shape. The length (depth) of the first groove 41 ranges from 0.4 mm to 0.8 mm. The length (depth) of the second groove 42 ranges from 2.0 mm to 2.9 mm.

The first grooves 41 within the plurality of resonant holes 4 may be not identical to one another. One of ordinary skill in the art may adjust the size of the first groove 41 on a case by case basis. However, the first grooves 41 should remain symmetrical. That being said, the multiple rectangular shapes should be symmetrical with respect to the perpendicular bisector of the first line on the open-circuited surface. Similarly, the size of the second grooves 42 is optimally adjusted on a case by case basis. However, the diameter of each of the second grooves 42 should remain identical. That being said, the round shapes are identical to one another in diameter.

In this embodiment, the depth ratio of the first groove 41 and the second groove 42 in the direction from the open-circuited surface to the short-circuited surface is ranged from ⅓ to ⅕. Preferably, the depth ratio of the first groove 41 and the second groove 42 in the direction from the open-circuited surface to the short-circuited surface is ranged from ¼.

At the same time, the first groove and the second groove are coaxially arranged, facilitating the manufacturing process and increasing the manufacturing efficiency.

Some of these embodiments provide an ability to decrease the overall size of the filter by arranging resonant holes on the filter. Because, under the condition that the frequency of the wave is kept unchanged, the overall size of the filter can be reduced while the wave transmission distance is increased.

In the embodiment, in order to improve the electrical characteristics of the filter, the hollow-out regions should be symmetrical. That being said, the first hollowed-out region 5 is symmetrical with respect to the perpendicular bisector of the first line on the open-circuited surface 11, and the two second hollowed-out regions 6 are symmetrical to each other with respect to the perpendicular bisector of the first line on the top surface 13.

Figure 4:
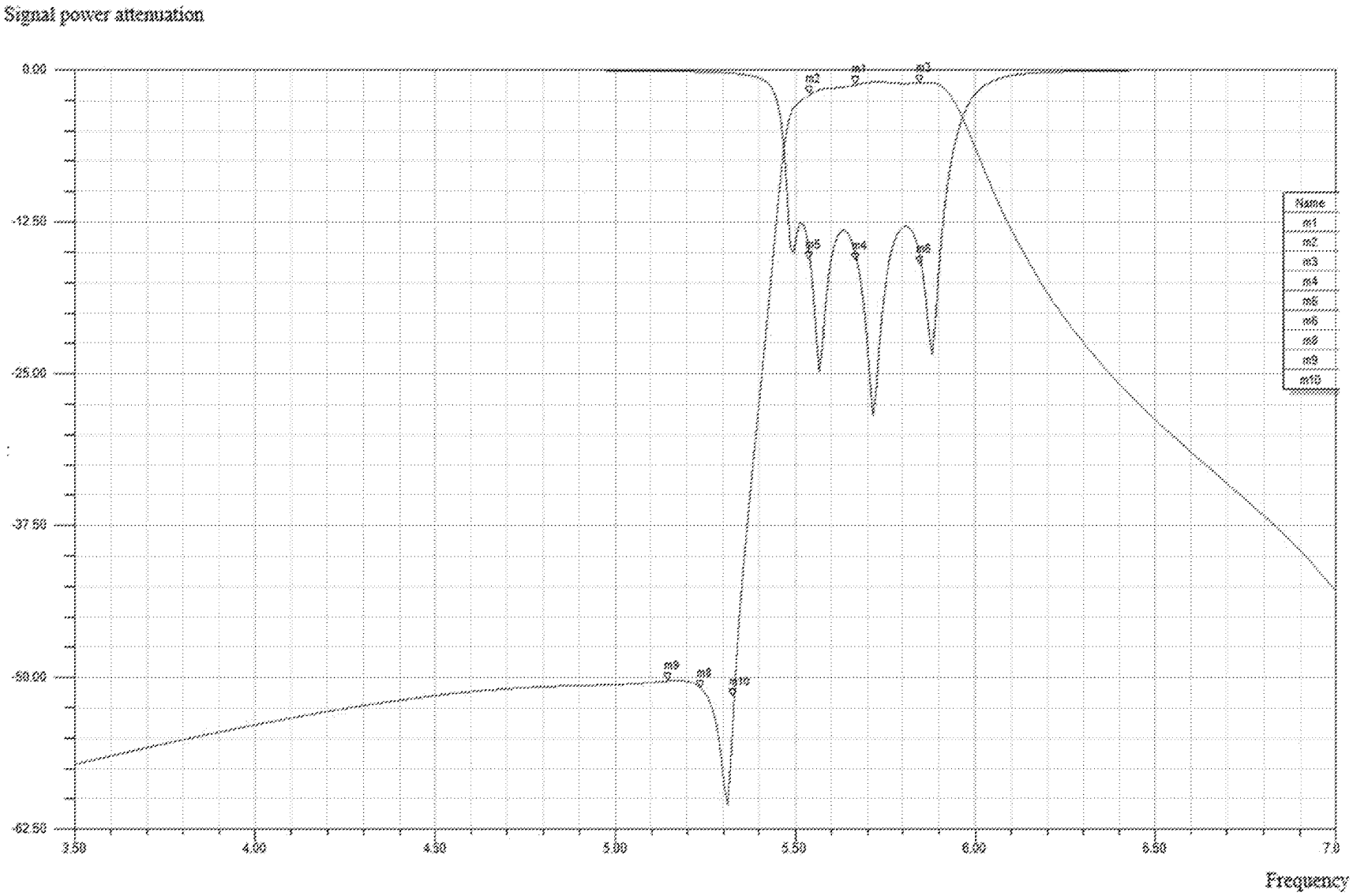
FIG. 4 is a diagram of characteristic curve of an equivalent circuit of embodiment 1 according to the present disclosure.

Please refer to FIG. 4, a characteristic curve of an equivalent circuit according to the present disclosure is shown. Value points m1, m2, m3, m4, m5, m6, m8, m9, m10 are marked on the curve. The lateral axis represents frequency, and the vertical axis represents the signal power attenuation. The shown filter is reduced by ⅓~⅔ than the existing dielectric filter and still exhibits an excellent electrical characteristics. The cost of manufacturing filters can be reduced, therefore, and the application of filters can be expanded.

Embodiment 2

Figure 5:
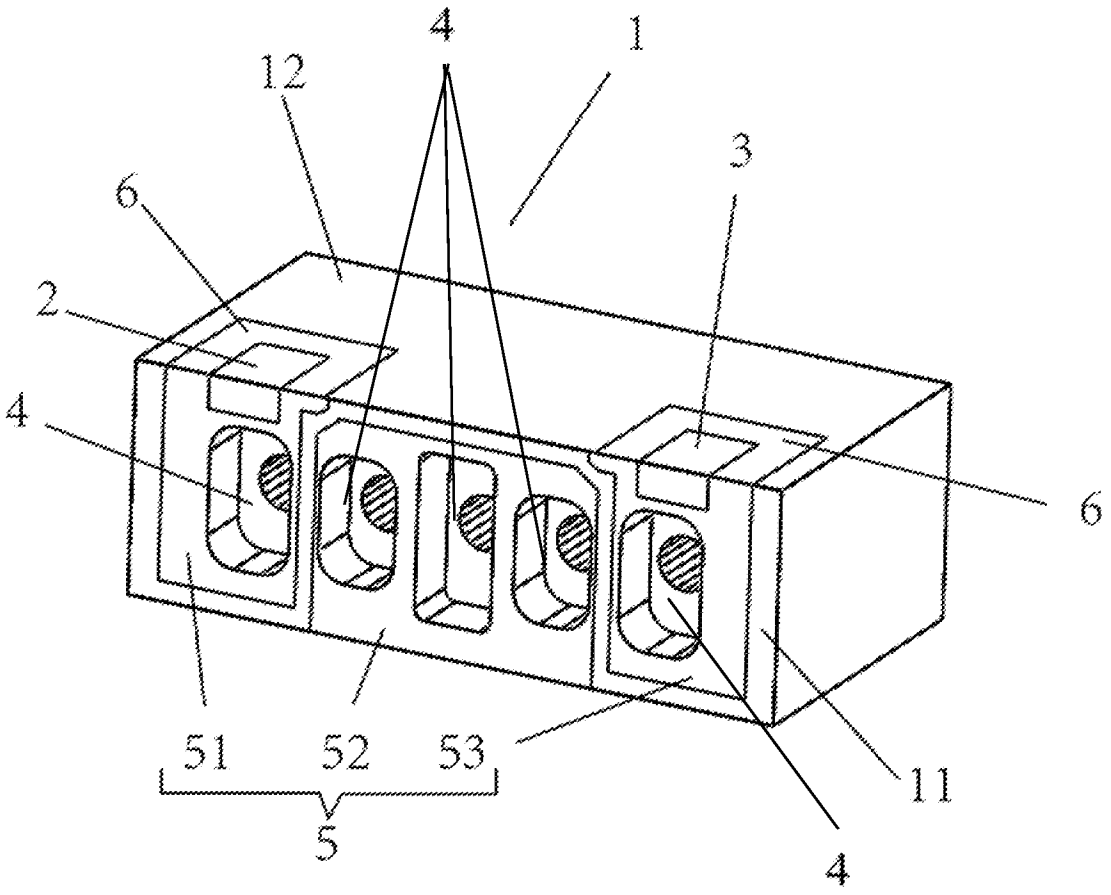
FIG. 5 is a perspective view of the multi-resonator bandpass filter in embodiment 2 according to the present disclosure.

Referring to FIG. 5, a multi-resonator bandpass filter is provided, which comprises a block 1, an input electrode 2 and an output electrode 3. The block 1 comprises an open-circuited surface 11 and a short-circuited surface 12 opposite to the open-circuited surface 11. Compared with the embodiment 1, the first hollowed-out region 5 in this embodiment further comprises a first subregion 51, a second subregion 52 and a third subregion 53 which are arranged with an interval distance. Wherein, the second subregion 52 is provided around the three resonant holes 4 in the middle of the five resonant holes. The first subregion 51 and the third subregion 53 are respectively disposed around the resonant holes 4 located at the left and right sides of the open-circuited surface 11.

Furthermore, the two second hollowed-out regions 6 are separately connected to the first subregion 51 and the third subregion 53.

Figure 6:
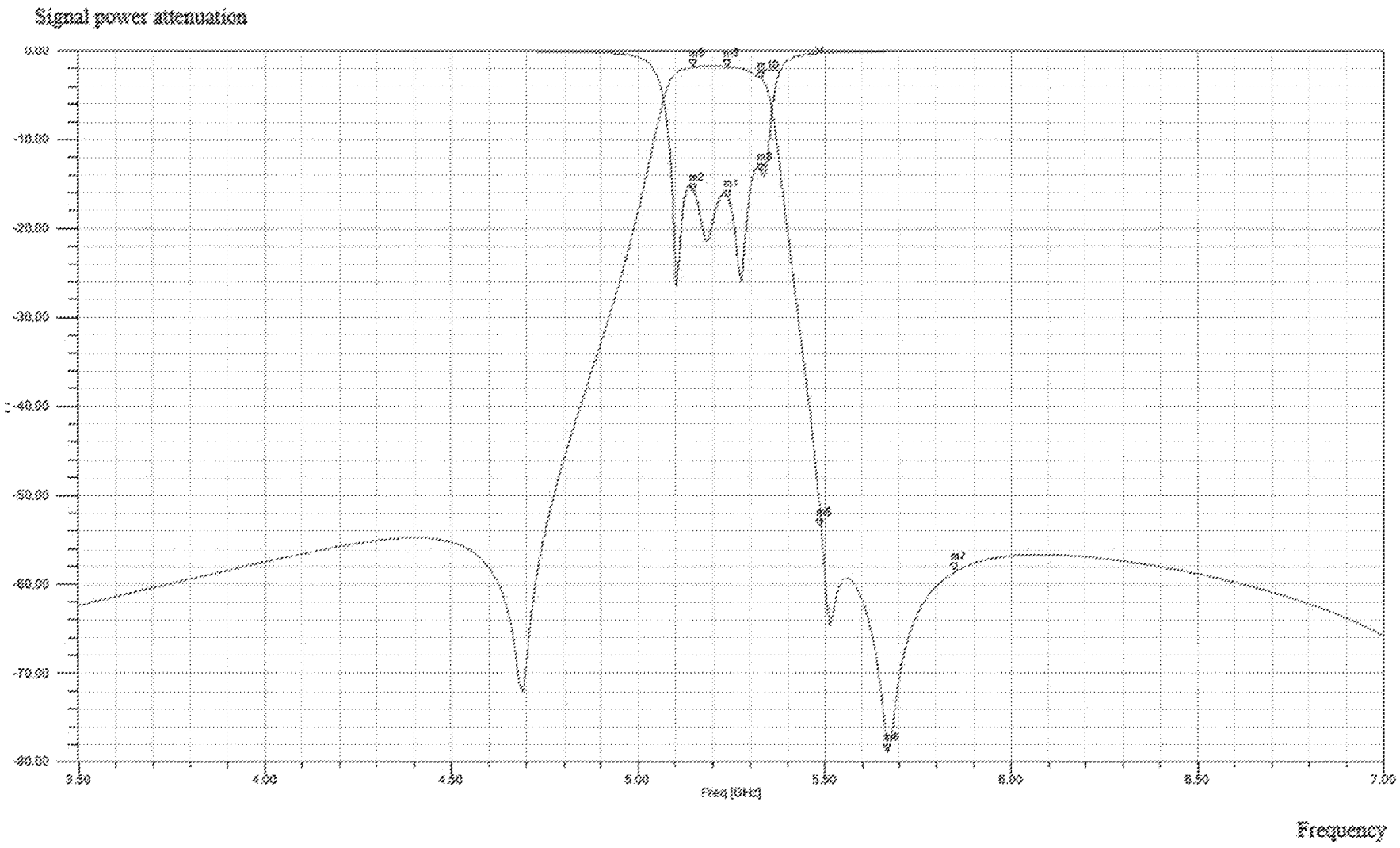
FIG. 6 is a diagram of characteristic curve of an equivalent circuit of embodiment 2 according to the present disclosure.

Please refer to FIG. 6, a characteristic curve of an equivalent circuit according to the embodiment is shown. Value points m1, m2, m3, m5, m6, m7, m8, m9, m10 are marked on the curve. The lateral axis represents frequency, and the vertical axis represents the signal power attenuation. The shown filter is reduced by ⅓~⅔ as compared to the existing dielectric filter and still exhibits an excellent electrical characteristics. The cost of manufacturing filters can be reduced, and therefore, the application of filters can be expanded.

The above description is merely some specific embodiments of the present invention. However, the protection scope of the present invention is not limited thereto. Any variation or substitution derived from the present invention without creative efforts falls within the protection scope of the present invention.

What is claimed is:

1. A multi-resonator bandpass filter, comprising:

a block, wherein the block is a substantially rectangular solid shape; the block comprises an open-circuited surface located at a front side of the block, a short-circuited surface opposite to the open-circuited surface, a surface located at a top of the block and connected between the open-circuited surface and the short-circuited surface, and a plurality of resonant holes; wherein the plurality of resonant holes are defined within the block and extend in parallel from the open-circuited surface to the short-circuited surface; the open-circuited surface is provided with a first hollowed-out region which is disposed around each of the resonant holes; the surface located at the top of the block is provided with two second hollowed-out regions, each of the two second hollowed-out regions is extended to the open-circuited surface and in communication with the first hollowed-out region;

an input electrode is disposed on one of the two second hollowed-out regions, and an output electrode is disposed on the other one of the two second hollowed-out regions; the block further comprises a ground metal layer and a resonant coating layer; the ground metal layer is coated on outer surfaces of the block except for the first hollowed-out region and the second hollowed-out region; the resonant coating layer is coated inside each of the resonant holes and is coupled with the ground metal layer at the short-circuited surface to form a short-circuited edge;

each of the resonant holes is coaxially provided with a first groove and a second groove in a direction from the open-circuited surface to the short-circuited surface; a cross-section of the first groove viewed from the open-circuited surface is substantially rectangular, and a cross-section of the second groove viewed from the open-circuited surface is substantially round; and the first hollowed-out region comprises a first subregion, a second subregion, and a third subregion; wherein the second subregion is disposed around resonant holes in the middle of the plurality of resonant holes, the first subregion and the third subregion are respectively disposed around the resonant holes at two sides of the block, a number of the resonant holes in the second subregion is greater than a number of the resonant holes in the first subregion or the third subregion, and the resonant holes in the first subregion, the second subregion, and the third subregion are symmetrical about a vertical central line of the open-circuited surface.

2. The multi-resonator bandpass filter according to claim 1, wherein a common edge between the open-circuited surface and the top surface is defined as a first line; and the first grooves are symmetrical with respect to a perpendicular bisector of the first line on the open-circuited surface.

3. The multi-resonator bandpass filter according to claim 2, wherein the first line is defined as g long side of the open-circuited surface, and the top surface, wherein a length of the long side is 6.2 mm to 5.4 mm; a length of a short side of the open-circuited surface is 2.5 mm to 1.7 mm; and a length of the short side of the top surface is 3.4 mm to 2.6 mm.

4. The multi-resonator bandpass filter according to claim 2, wherein the second grooves have a common diameter; and a minimum side length of the first groove is larger than a diameter of the second groove.

5. The multi-resonator bandpass filter according to claim 4, wherein the number of the resonant holes is five.

6. The multi-resonator bandpass filter according to claim 5, wherein the first hollowed-out region is symmetrical about the perpendicular bisector of the first line on the open-circuited surface, and the two second hollowed-out regions are symmetrical to each other about a perpendicular bisector of the first line on the top surface.

7. The multi-resonator bandpass filter according to claim 1, wherein a depth ratio of the first groove and the second groove in the direction from the open-circuited surface to the short-circuited surface is in a range of ⅓ to ⅕.

8. The multi-resonator bandpass filter according to claim 1, wherein the two second hollowed-out regions are separately in communication with the first subregion and the third subregion.

9. The multi-resonator bandpass filter according to claim 1, wherein the input electrode disposed on the one of the two second hollowed-out regions and the output electrode disposed on the other of the two second hollowed-out regions are formed by screen printing.

* * * * *